United States Patent [19]

Segerstrom

[11] 4,131,400

[45] Dec. 26, 1978

[54] HYDRAULIC ROTARY SCREW MACHINE WITH AXIAL BALANCING PISTON

[75] Inventor: Lars Segerström, Skärholmen, Sweden

[73] Assignee: Aktiebolaget Imo-Industri, Stockholm, Sweden

[21] Appl. No.: 788,968

[22] Filed: Apr. 19, 1977

[30] Foreign Application Priority Data

Apr. 27, 1976 [SE] Sweden ..... 7604832

[51] Int. Cl.[2] ..... F04C 17/12; F04C 29/00

[52] U.S. Cl. ..... 418/203

[58] Field of Search ..... 418/197, 201, 203, 202

[56] References Cited

U.S. PATENT DOCUMENTS

| | | | |
|---|---|---|---|
| 2,590,561 | 3/1952 | Montelius | 418/203 X |
| 2,924,181 | 2/1960 | Sennet | 418/203 |
| 4,028,025 | 6/1977 | Lonnebring | 418/203 X |

FOREIGN PATENT DOCUMENTS

| | | | |
|---|---|---|---|
| 936679 | 9/1963 | United Kingdom | 418/197 |

*Primary Examiner*—Carlton R. Croyle
*Assistant Examiner*—Leonard E. Smith
*Attorney, Agent, or Firm*—Haseltine, Lake, & Waters

[57] ABSTRACT

A hydraulic screw machine having a housing employing a screw assembly with a drive screw and cooperating idler screws. The drive screw is sealably connected to a shaft extending beyond the housing on the high pressure side and has associated therewith a balance piston for acting on the screw drive. The drive screw is journalled to the shaft via bearings in the form of a self-adjusting plate surrounding the shaft. The plate is disposed between abutment surfaces connected to the housing for limiting its axial movement. A leakage channel between the piston and the housing is connected to the high pressure side of the machine and is determined by the balance piston.

1 Claim, 1 Drawing Figure

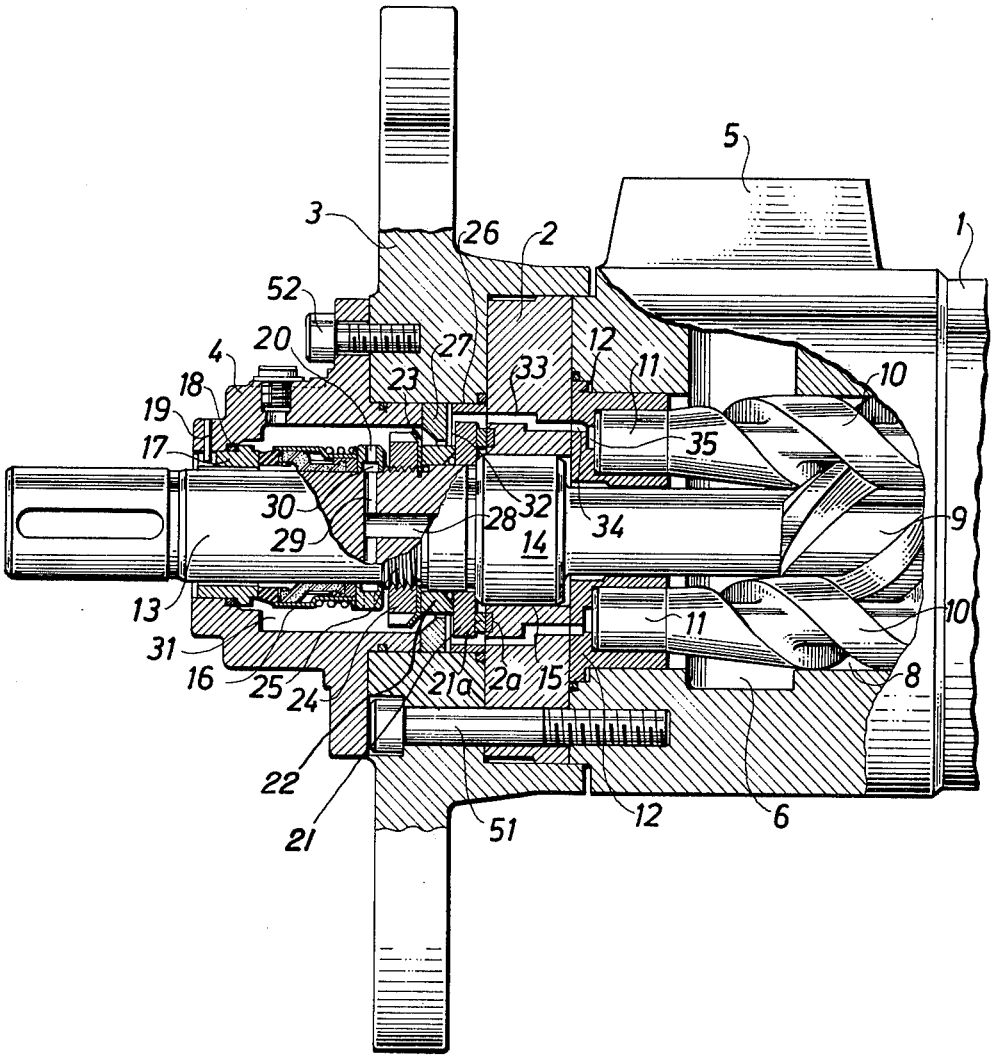
5
1
3
26
2
52
20
27
12
4
23
33
11
10
18
19
17
35
30
32
28
34
9
29
14
13
11
10
31
16
25
24
21a
2a
15
8
22
21
51
12
6

HYDRAULIC ROTARY SCREW MACHINE WITH AXIAL BALANCING PISTON

The present invention refers to such hydraulic screw machines of the type having a screw assembly comprising a drive screw and one or more idling screws arranged in a casing and designed in a manner such that chambers are formed by surface contact between the screws and between the screws and the casing, which chambers shift axially as the screws rotate. Such a machine is able to operate as a pump, when the drive screw is driven by a motor, in which case fluid is transported from the low pressure side to the high pressure side of the chambers formed by the screws and the casing, or as a motor, in which case fluid is fed in on the high pressure side and is moved in the chambers to the low pressure side while driving the screws, in which case the drive screw drives an appliance coupled to the shaft of the screw.

The screw assembly and the casing are arranged in an external housing, the shaft of the drive screw passing through the end wall of the casing located adjacent the high pressure side via a seal. Normally, the shaft of the drive screw is journalled in ball bearings. Ball bearings, however, impose some limitations. On the one hand ball bearings cannot be used in conjunction with fuel oils, while on the other hand, lubrication of the bearing creates a problem. If the ball bearing is placed externally of the seal, in which case the machine can be used as a pump for both fuel oils and lubricating oils, or as a motor, the bearing must be lubricated even when the machine is used for conveying lubricating oils. If it is placed axially inwardly of the seal no lubrication is necessary, but the machine cannot be used as a pump for fuel oils. If the machine is used as a motor, the rotary speed of the screws will be limited by the heat produced by the ball bearing when this is completely filled with oil.

An object of the present invention aims to eliminate these disadvantages and in particular to provide bearing means for the drive screw which will enable the screw machine to be used in all the aforementioned cases, thereby reducing the number of variations otherwise necessary. Other objects and advantages will be evident from the following.

According to the invention, the aformentioned problem is solved by a machine constructed in the manner disclosed in claim 1.

In the machine according to the invention pressure acts on a plate which is self-adjustable axially so that the requisite balancing pressure is created beneath the plate. Normally, such a device would have to be made to precise measurements in order to ensure that any leakage across the plate would not be of such magnitude as to affect deleteriously the efficiency of the pump or the motor. In accordance with a particularly advantageous embodiment of the invention, the drive screw is provided with a balance piston which is smaller and shorter than usual. In this case leakage is mainly determined by the balance piston, and can therefore be kept under control.

The surface of the bearing is intended to absorb axial forces acting rearwardly in the pump or the motor. Feed pressure in a pump or a motor will normally strive to urge the drive screw towards its foward axial bearing. In order to achieve full balance, the balance piston is normally given a larger diameter than the external diameter of the drive screw, since the drive screw has no balance piston on the low pressure side. By making the balance piston smaller, in accordance with the invention, the advantage is afforded whereby the screw blank can also be made smaller, which saves both material and work.

The invention will now be described in more detail with reference to the accompanying drawing, which shows, partly in section, that part of the machine according to the invention located on the high pressure side. The illustrated screw machine (pump or motor), of which only that part located on the high pressure side is visible in the drawing, includes a housing, comprising a substantially cylindrical main component 1, an intermediate member 2 abutting said main component, an end member 3 which abuts the intermediate member 2, a cap 4, and an end piece mounted on the end of the main component not shown in the drawing. These elements are secured together by suitable means, e.g. by means of screws 51, 52. Seals in the form of O-rings are arranged in the manner shown in the drawing. One end of the main component 1 is provided with an outlet 5 connected with an outlet chamber 6. As will be understood, the main component is provided at the end thereof which is not shown in the drawing with a similar inlet and a similar inlet chamber.

Between the inlet chamber and the outlet chamber 6 there extends an axial channel 8, which comprises is known fashion three mutually intersecting, parallel cylindrical bores, in which a drive screw 9 and two idling screws 10 are arranged with the helix of one screw meshing with the helix of another screw and sealing against the walls of the channel 8.

The ends of the idler screws 10 on the low pressure side extend freely into an inlet chamber (not shown) while the other ends of said screws 10 are provided with shaft journals 11, mounted in sleeves 12 arranged at one end of the main component. As will be more apparent from the following, the end surfaces of the journals 11 are subjected to pressure prevailing on the low pressure side, so that the idler screws are balanced.

The drive screw 9 is formed integrally with a drive shaft 13, which extends through the intermediate member 2, the end member 3, and the cap 4, so that it can be coupled to a drive motor or to a driven appliance, depending upon whether the machine is intended to work as a pump or as a motor. The section of the drive shaft situated in the intermediate member 2 is extended into a balance piston 14, which slides, with a small amount of play, in a central recess 15 in the intermediate member.

A shaft seal 16 is arranged within the cap 4 between an outer ring 17 and an inner ring 20, which bears against a shoulder on the shaft, said outer ring bearing against a shoulder in the cap via an intermediate O-ring 18 and being fixed by means of a pin 19.

A plate 21 surrounds the driving shaft 13 axially outwardly of the balance piston 14 one side of which against an outer surface of the piston 14, and another side of which bears against a ring 22 secured via a plate 23, by a nut 24 screwed on to a threaded section 25 of the shaft 13.

In the central bore of the end member 3 is arranged a sleeve 26, which surrounds the plate 21, and a sleeve 27, which surrounds the ring 22. These two elements are held fast against the intermediate member 2 by a cylindrical flange on the cap 4, which flange juts out into the bore of the end member. The axial length of the sleeve 26 is somewhat greater than the thickness of the plate 21, and the plate 21 has therefore limited axial movement between a position where it rests against the intermediate member 2 (via wear rings 2*a* 21*a*, inserted into the mutually opposing surfaces of the intermediate member 2 and the plate 21), and a position where it rests against the inner radial surface of the sleeve 27.

The drive screw 9 has a longitudinal channel 28 extending from the inlet-chamber end of the screw to a location on the drive shaft 13 where radial channels 29 extend from the central channel 28 to the circumference of the drive shaft. These channels 29 are connected with chambers 35 in the sleeves 12 at the end surfaces of the shaft journals 11, through apertures 30 in the ring 20, a space 31 surrounded by the cap 4, a space between the sleeve 27 and the ring 22, radial grooves 32 in the iinner radial surface of the sleeve 27, a space between the sleeve 26 and the plate 21, axial channels 33 in the intermediate member 2, and channels 34 in the sleeves 12, so that the journals are subjected to the pressure prevailing on the low pressure side, as mentioned above.

Likwise, the outer side of the plate 21 is subjected to the pressure prevailing on the low pressure side, while its inner surface (inside the ring 21*a* ) is subjected to a higher pressure due to leakage of fluid from the outlet chamber 6 past the balance piston 14 through the recess 15. The pressure thus acting against the inner side of the plate 21 lies between the pressures on the high pressure side and the low pressure side of the machine and is the result of the remaining hydraulic forces acting on the drive screw at the high and low pressure side of the machine. The amount of oil passing over the bearing arrangement is initially decided by the dimensions (the length and the width) of the leakage channel existing between the cylindrical surface of the balance piston 14 and the wall of the aperture 15. In operation, the plate will adjust itself to such a position that the necessary balance pressure is built up.

Since the pressure thus is partly taken up by the plate 21, the balance piston 14 can suitably have a diameter equal to or smaller than the diameter of the drive screw 9 with consequent advantages, as has already been mentioned.

The shaft-seal space 31 does not have to be connected to the low pressure side of the machine but can be drained separately to a tank. This arrangement is used when the pressure on the low pressure side is high, which causes unsuitable working conditions with regard to the mechanical shaft seal. In such an arrangement, the bore 28 in the drive screw is plugged and the idler screws are balanced separately in the balance sleeves 12, which communicate with the low pressure side of the machine through longitudinal bores in the idler screws. In this case, channels 33 and 34 are omitted.

While I have illustrated a preferred embodiment of my invention, many modifications may be made without departing from the spirit of the invention and I do not wish to be limited to the precise details of construction set forth, but desire to avail myself of all changes within the scope of the appended claims.

What I claim:

1. A hydraulic screw machine comprising a housing, a drive screw extending axially of the housing; a plurality of idler screws extending axially of the housing and intermeshing with said drive screw; a shaft integral with said drive screw and protruding from one end of said housing; means forming a shaft seal space about said shaft at said end of the housing, said shaft seal space being at a pressure lower than that of a high-pressure side of the machine; a piston formed integral with a shaft of the drive screw, having an outer diameter equal to or smaller than the outer diameter of the drive screw, said piston extending with a close fit through a bore in the housing between the shaft-seal space and said high-pressure side; a plate of greater diameter than the piston being affixed to said shaft at a side of the piston facing away from said drive screw; a leak passage along the periphery of the piston: said plate having a side facing away from the piston being subjected to pressure prevailing in said shaft seal space and the opposite side of the plate radially outwardly of the piston being subjected to a pressure intermediate the pressure prevailing in said shaft seal space and the pressure at said high-pressure side of said machine; abutment means connected to said housing, facing radially outward portions of sais opposite sides of the plate and being adapted to confine said plate in an axial direction while permitting limited axial movement thereof between said abutment means.

* * * * *